US010644456B2

(12) United States Patent
Kojima

(10) Patent No.: US 10,644,456 B2
(45) Date of Patent: May 5, 2020

(54) SHIELD CONNECTOR

(71) Applicant: Sumitomo Wiring Systems, Ltd., Yokkaichi, Mie (JP)

(72) Inventor: Yusuke Kojima, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/254,696

(22) Filed: Jan. 23, 2019

(65) Prior Publication Data

US 2019/0237908 A1 Aug. 1, 2019

(30) Foreign Application Priority Data

Jan. 26, 2018 (JP) ..... 2018-011440

(51) Int. Cl.

| | |
|---|---|
| ***H01R 13/648*** | (2006.01) |
| ***H01R 13/6581*** | (2011.01) |
| ***H01R 13/506*** | (2006.01) |
| *H01R 12/72* | (2011.01) |
| *H01R 13/6593* | (2011.01) |

(52) U.S. Cl.

CPC ..... *H01R 13/6581* (2013.01); *H01R 13/506* (2013.01); *H01R 12/724* (2013.01); *H01R 13/6593* (2013.01)

(58) Field of Classification Search

CPC ..... H01R 13/6581; H01R 12/725; H01R 13/6658; H01R 13/521

USPC ..... 439/607.01

See application file for complete search history.

(56) References Cited

U.S. PATENT DOCUMENTS

| | | | | |
|---|---|---|---|---|
| 6,582,252 | B1 * | 6/2003 | Lin | H01R 12/725 439/607.46 |
| 7,922,520 | B2 * | 4/2011 | Mizukami | H01R 13/6658 439/493 |
| 10,170,864 | B1 * | 1/2019 | Hsu | H01R 13/521 |

FOREIGN PATENT DOCUMENTS

| | | |
|---|---|---|
| JP | 2006-286223 | 10/2006 |

* cited by examiner

*Primary Examiner* — Jean F Duverne
(74) *Attorney, Agent, or Firm* — Gerald E. Hespos; Michael J. Porco; Matthew T. Hespos

(57) ABSTRACT

A shield connector (10) includes terminals (50) arranged side by side in a width direction. A shield shell (70) collectively surrounds the terminals (50) on an outer peripheral side, and a dielectric (40) interposed between the respective terminals (50) and the shield shell (70). The shield shell (70) includes a back wall (74) serving as a cover for covering an exposed surface of each terminal (50) from the dielectric (40). The back wall (74) includes bottomed recesses (88) at positions facing areas, across which the respective terminals (50) are adjacent in the width direction, on an outer surface (87) on a side opposite to an inner surface (86) facing the respective terminals (50).

12 Claims, 9 Drawing Sheets

SHIELD CONNECTOR

BACKGROUND

Field of the Invention

The invention relates to a shield connector.

Related Art

Japanese Unexamined Patent Publication No. 2006-286223 discloses a shield connector for high-speed communication. This known connector has terminals arranged in parallel in a width direction, and a shield shell collectively surrounds the terminals. A dielectric is provided between the terminals and also between the terminals and the shield shell for electrically insulating the terminals and the shield shell.

Each terminal has a substantially L shape and includes a vertically extending lead portion exposed from the dielectric. A lower end of the lead portion is inserted into a through hole of a board to be connected. The shield shell is in the form of a box that is open forward and down, but includes a back wall for closing a rear surface. The back wall of the shield shell faces the lead portions of the respective terminals arranged in the width direction.

A design concept of this conventional shield connector is to generate a return current paired with a signal current on an inner surface facing each terminal in the back surface wall of the shield shell to cancel out electromagnetic noise. However, the return current may flow around to an outer surface on a side opposite to the inner surface in the back surface wall via a lower end edge of the back surface wall to increase a current density on the outer surface of the back wall. A phenomenon in which a current density increases on a surface of a conductor in this way is known as a skin effect. As a result of the skin effect, the current concentrated on the outer surface of the back wall may secondarily radiate electromagnetic noise (neighborhood noise) to the surrounding since the outer surface is exposed and not electromagnetically shielded. Thus, an original function as the shield connector is lost.

The invention was completed on the basis of the above situation and aims to reduce neighborhood noise generated from a shield connector itself.

SUMMARY

The invention relates to a shield connector with terminals arranged side by side in a width direction. A shield shell collectively surrounds the terminals on an outer peripheral side, and a dielectric is interposed between the terminals and the shield shell. The shield shell includes a cover for covering an exposed surface of each terminal from the dielectric. The cover includes a bottomed recess or projection at a position facing an area, across which the terminals are adjacent in the width direction, on an outer surface on a side opposite to an inner surface facing the respective terminals.

A current flows in each terminal, and thus a return current flows on the inner surface of the cover of the shield shell. The return current flows around to the outer surface from the inner surface of the cover. The currents appearing on the outer surface of the cover flow in areas (hereinafter, referred to as inter-terminal facing areas) facing the areas, across which the respective terminals are adjacent in the width direction, and may cause neighborhood noise to be generated from the shield shell. However, the bottomed recess or projection is provided in the inter-terminal facing area of the outer surface of the cover. Thus, a density per unit area of the current flowing in the inter-terminal facing area (current density) can be lowered and neighborhood noise can be reduced as compared to the case where no bottomed recess or projection is provided.

End parts of the terminals are exposed side by side in the width direction from an end edge of the covering plate, and one end of the bottomed recess or projection reaches the end edge of the covering. According to this configuration, neighborhood noise can be reduced on the end edge side of the cover, which serves as a starting point of the currents flowing around to the outer surface of the cover.

In one embodiment, plural bottomed recesses or projections are arranged side by side in the width direction. According to this configuration, the current density of the currents flowing in the facing part of the outer surface of the cover can be lowered and an effect of reducing neighborhood noise can be enhanced.

The cover may include the bottomed recess at the position facing the area, across which the respective terminals are adjacent in the width direction, on the outer surface on the side opposite to the inner surface facing the respective terminals. According to this configuration, the bottomed recess can be formed easily, such as by striking the outer surface of the covering plate.

DETAILED DESCRIPTION

Hereinafter, one embodiment is described on the basis of the drawings. A shield connector 10 according to this embodiment is a board shield connector to be mounted on a printed circuit board 60 and is used in a circuit for transmitting high-frequency signals. In the following description, a side of the shield connector 10 to be connected to an unillustrated mating connector is referred to as a front (left side of FIGS. 3 to 5), and a side where the board 60 is located is referred to as a lower side concerning a vertical direction.

Figure 4:
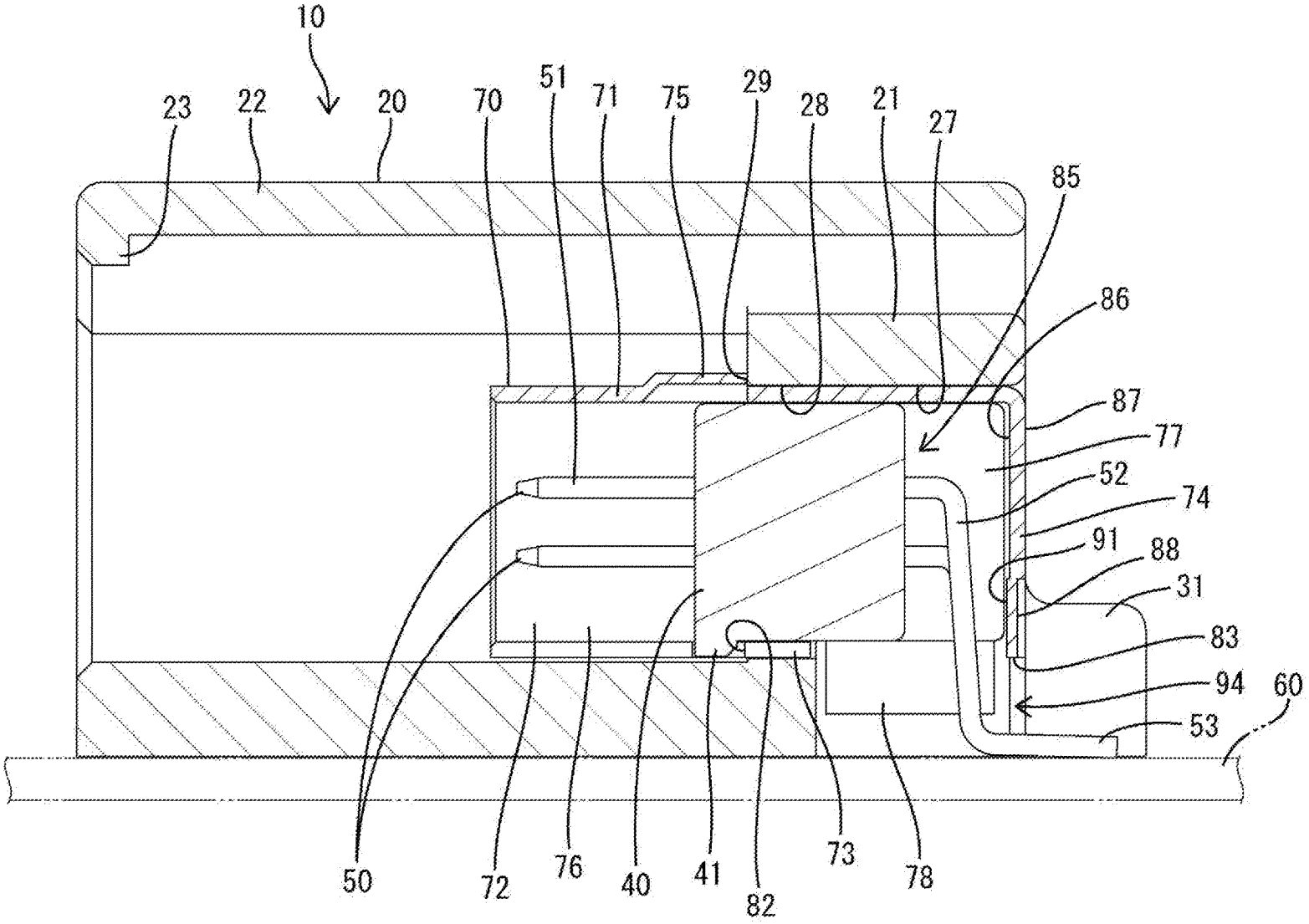
FIG. 4 is a section along B-B of FIG. 2.

As shown in FIG. 4, the shield connector 10 includes a housing 20 disposed on the upper surface of the board 60, a dielectric 40 to be mounted into the housing 20, terminals 50 to be held through the dielectric 40, and a shield shell 70 to be mounted into the housing 20 for surrounding each terminal 50 and the dielectric 40.

The housing 20 is made of synthetic resin and includes a back wall 21 in the form of a rectangular block and a receptacle 22 in the form of a rectangular tube projecting forward from an outer part of the back wall 21. A lock 23 projects down on a front part of an upper wall of the receptacle 22. The unillustrated mating connector is fit into the receptacle 22 and is held retained in the receptacle 22 by being locked by the lock 23.

Figure 1:
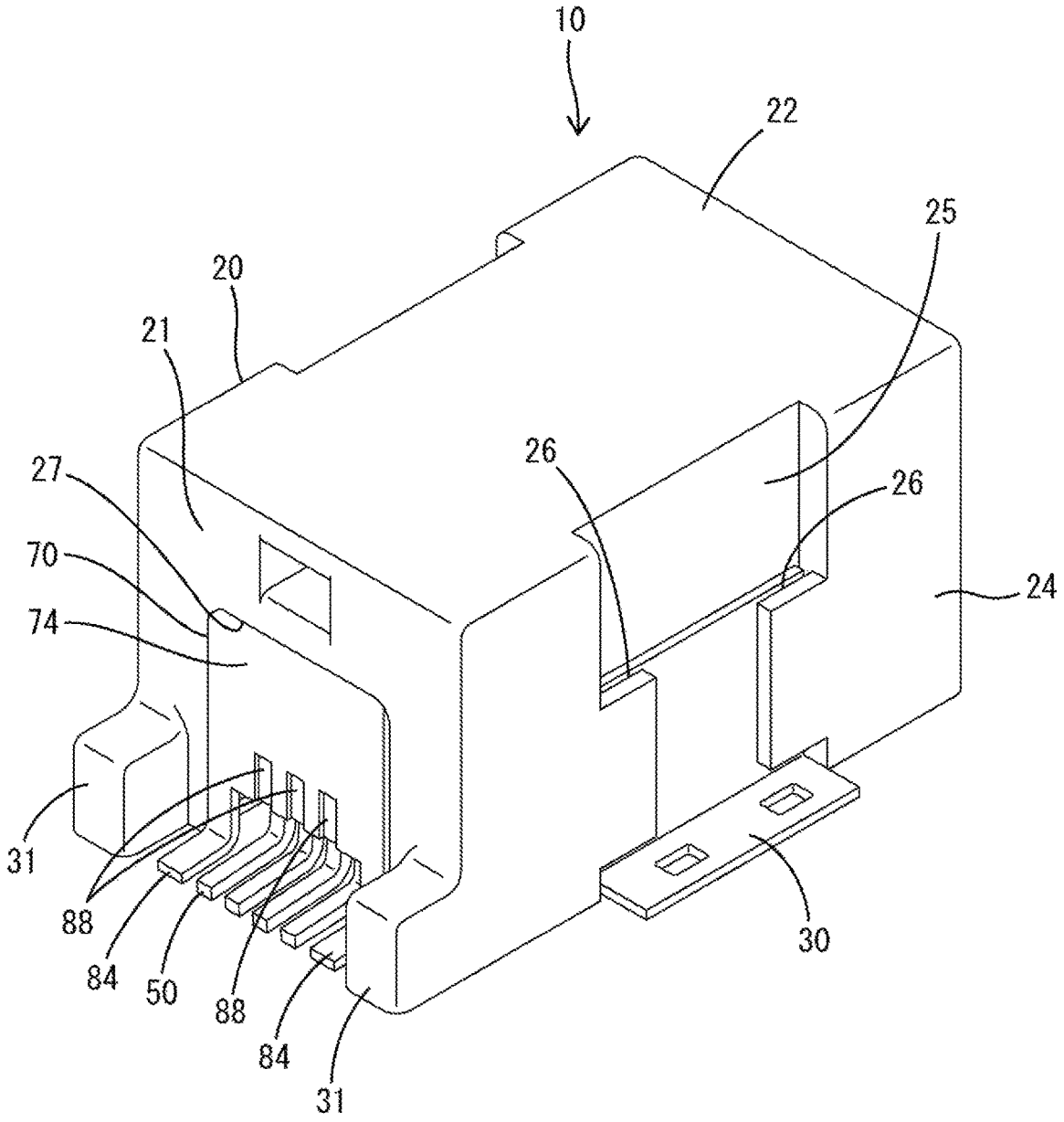
FIG. 1 is a perspective view of a shield connector according to one embodiment of the invention obliquely viewed from an upper-rear side.
Figure 2:
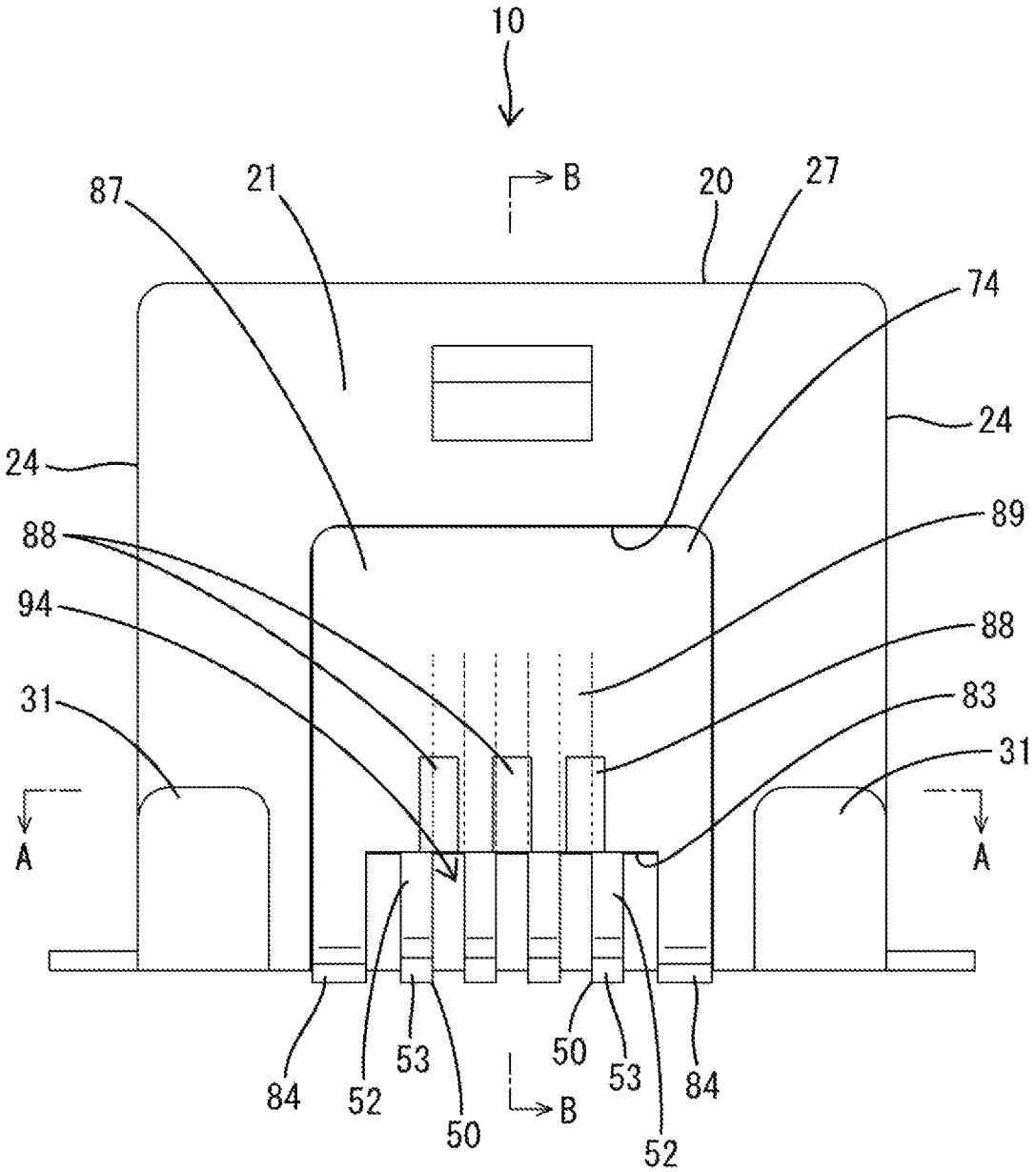
FIG. 2 is a back view of the shield connector.
Figure 5:
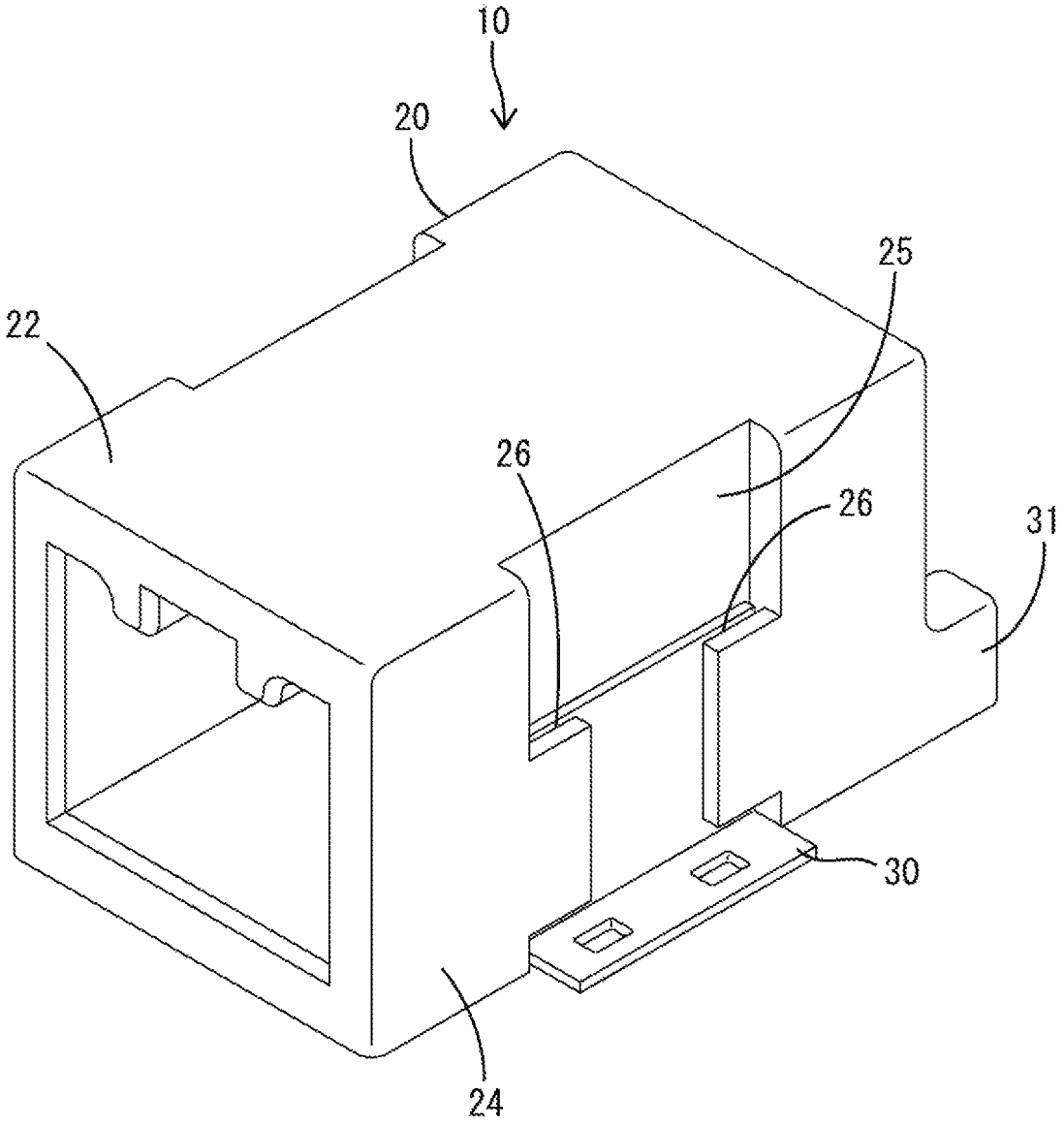
FIG. 5 is a perspective view of the shield connector viewed from an upper front side.

Both side walls of the receptacle 22 have outer side surfaces 24 extending substantially vertically from the upper surface of the board 60, as shown in FIG. 2, and each of the outer side surfaces 24 includes a fixing member mounting portion 25 in the form of a recessed groove for receiving a fixing member 30, as shown in FIGS. 1 and 5. Slit-like holding grooves 26 vertically penetrate front and rear parts of each fixing member mounting portion 25.

Figure 3:
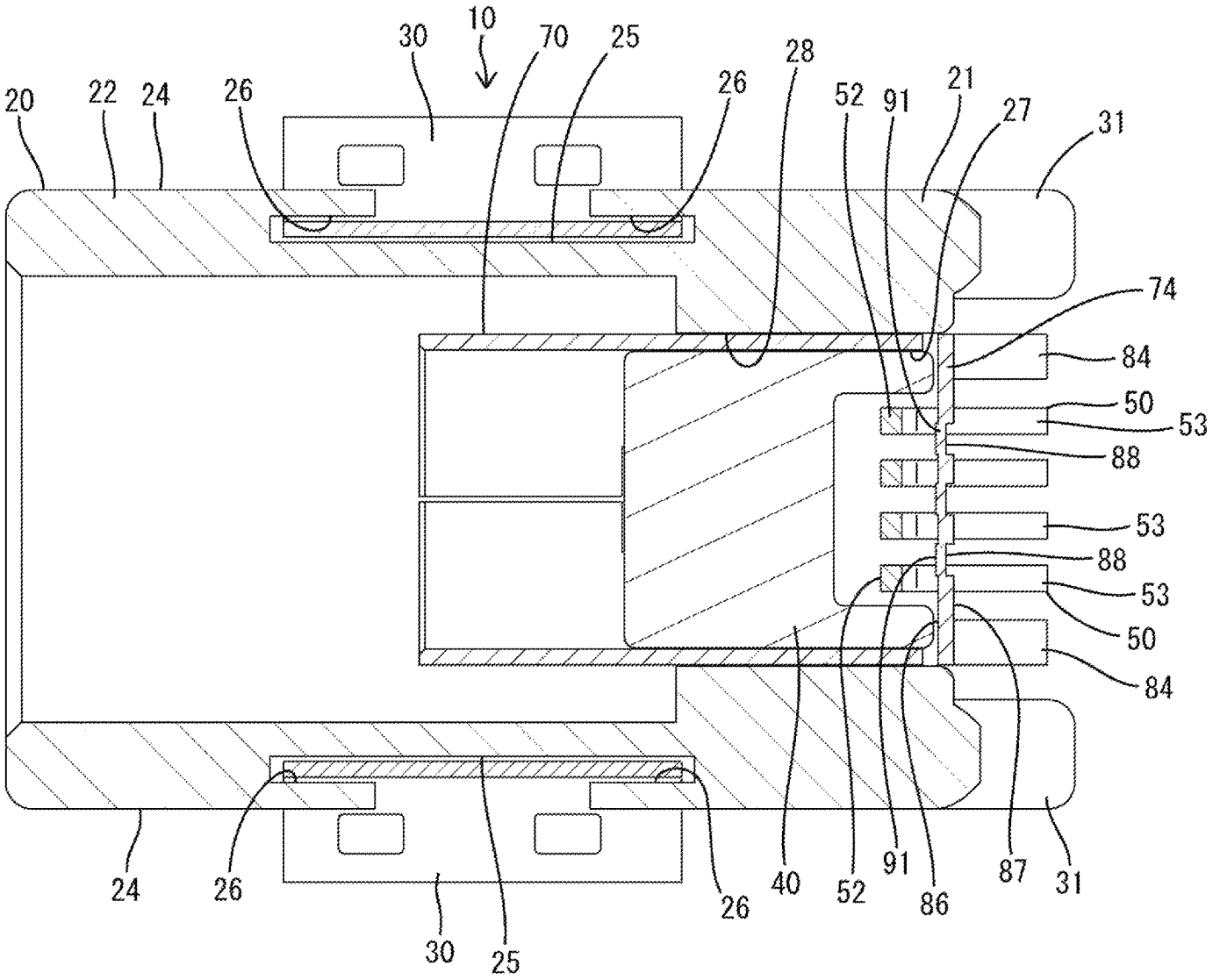
FIG. 3 is a section along A-A of FIG. 2.

Each fixing member 30 is a substantially L-shaped metal plate and is mounted into the fixing member mounting portion 25 by having both front and rear ends of a vertical part press-fit into the front and rear holding grooves 26, as shown in FIG. 3. Two of the fixing members 30 are provided to correspond to the fixing member mounting portions 25 of the respective outer side surfaces 24. The housing 20 is fixed to the board 60 via the fixing members 30 by horizontal parts of the fixing members 30 being soldered to the upper surface of the board 60.

The back wall 21 includes an insertion portion 27 into which the dielectric 40 and the shield shell 70 are to be inserted. The insertion portion 27 is open forward, rearward and down by recessing the back wall 21. Further, the back wall 21 includes a rectangular through hole 28 that defines a front space of the insertion portion 27. As shown in FIG. 4, the front surface of the back wall 21 faces the receptacle 21 and a retaining edge 29 is on an upper part of an opening of the through hole 28 for locking the shield shell 70.

The back wall 21 includes two protection walls 31 projecting rearward on lower end parts of both widthwise sides. The protection walls 31 can be placed on the upper surface of the board 60.

The dielectric 40 is made of synthetic resin and is in the form of a rectangular block. The terminals 50 are mounted through the dielectric 40 in the front-rear direction so that the terminals 50 are arranged in parallel in a width direction in upper and lower rows with the terminals 50 in the upper row shifted from those in the lower row substantially by a half pitch. Thus, the terminals 50 are arranged to be insulated from each other (see FIGS. 3 and 4). Further, by interposing the dielectric 40 between the terminals 50 and the shield shell 70, the terminals 50 and the shield shell 70 are held in an insulated state.

Each terminal 50 is a conductive rod-like or pin-like member having a rectangular cross-section and serves as a signal terminal for transmitting a high-frequency signal. As shown in FIG. 4, each terminal 50 includes a mating terminal connecting portion 51 extending in the front-rear direction, a lead intermediate portion 52 extending down from the rear end of the mating terminal connecting portion 51, and a lead end 53 extending rearward from the lower end of the lead intermediate portion 52. The mating terminal connecting portion 51 is press-fit through the dielectric 40 to project into the receptacle 22. When the shield connector 10 is connected to the mating connector, the mating terminal connecting portions 51 are connected electrically to unillustrated mating terminal fittings in the mating connector.

The lead intermediate portion 52 of each terminal 50 in the upper row is longer than that of each terminal 50 in the lower row, and the lead intermediate portion 52 of each terminal 50 has the lower end thereof aligned at the same height. Further, the lead intermediate portions 52 of the terminals 50 are parallel substantially at fixed intervals in the width direction.

The lead end 53 of each terminal 50 is in contact with the upper surface of the board 60 and is soldered and connected to a conductor pattern for a signal circuit of the board 60. The soldering of the lead end 53 of each terminal 50 and the board 60 and the soldering of the fixing members 30 and the board 60 are performed collectively by reflow soldering.

Figure 6:
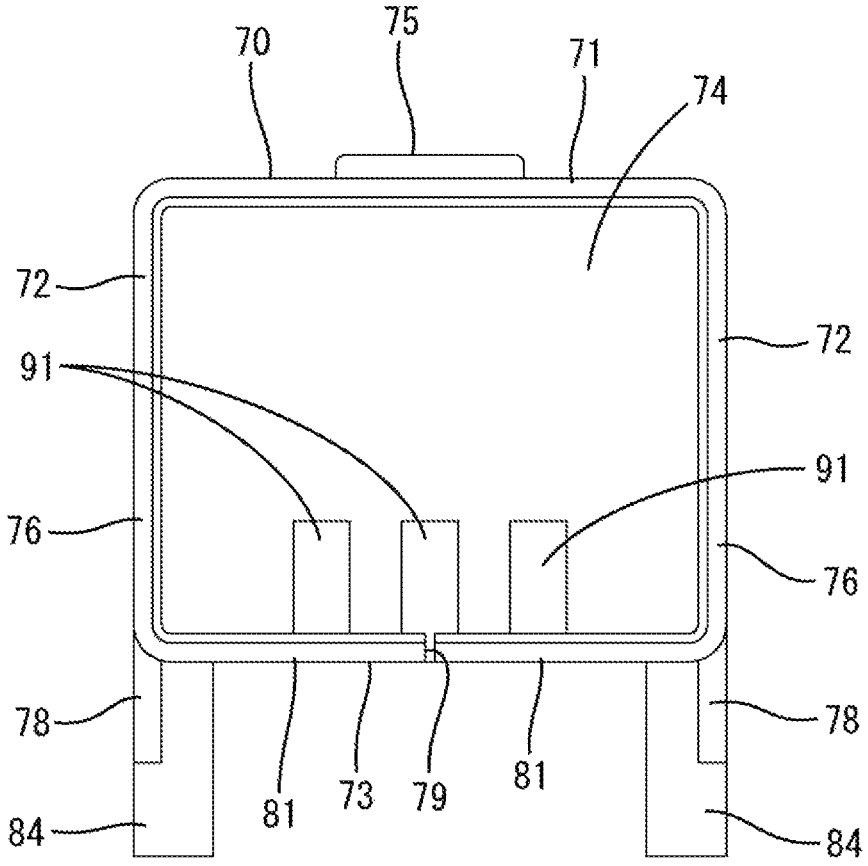
FIG. 6 is a front view of a shield shell.
Figure 7:
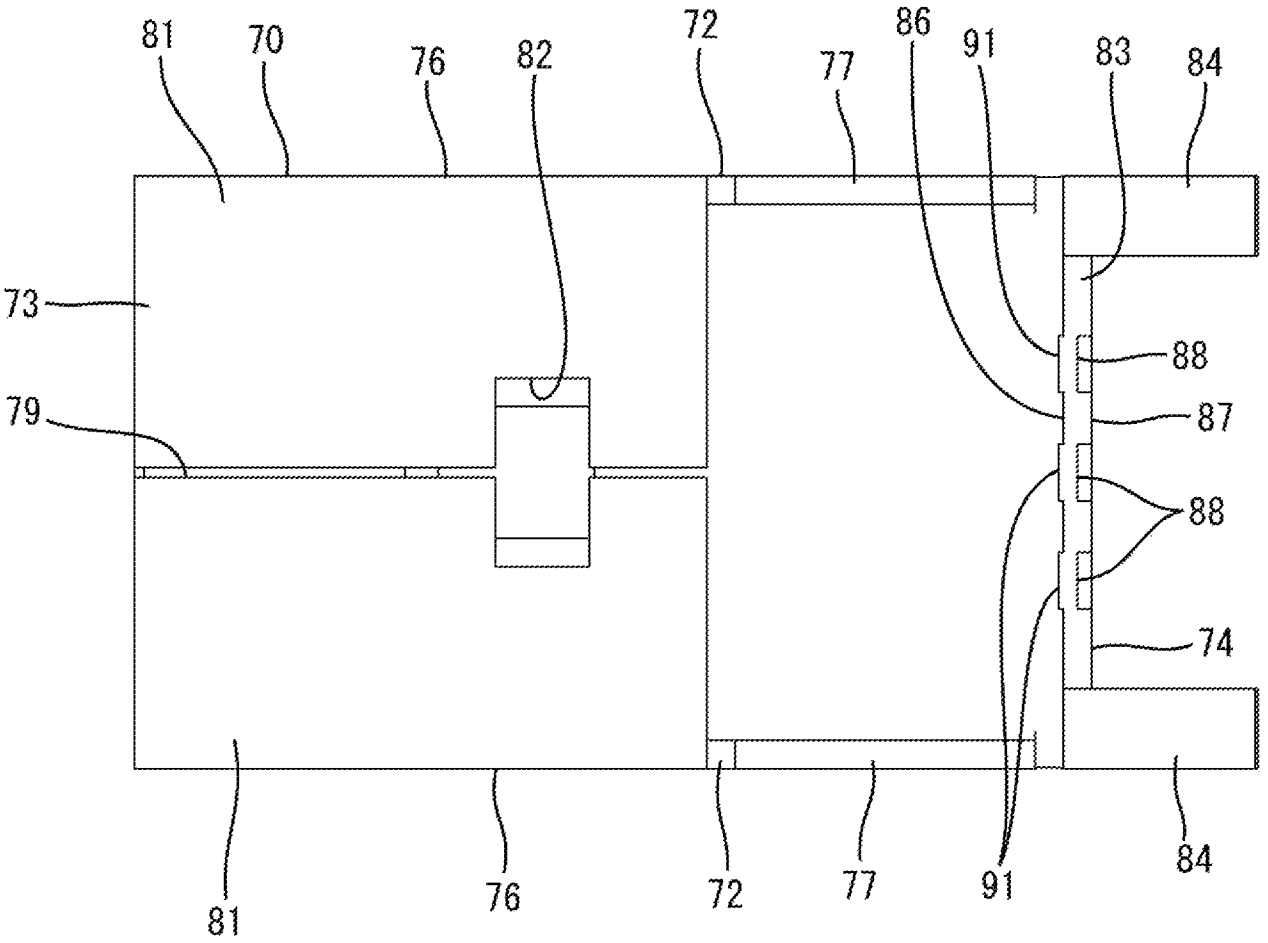
FIG. 7 is a bottom view of the shield shell.

The shield shell 70 is formed by stamping a conductive metal material into a predetermined shape and, then, bending the stamped piece. As shown in FIGS. 6 and 7, the shield shell 70 is box-shaped and includes a ceiling 71, two side walls 72, a bottom wall 73 and a back wall 74 (cover). The ceiling 71, the two side walls 72 and the bottom wall 73 cover the dielectric 40 on four sides, and are fit and inserted into the through hole 28 of the back wall 21 of the housing 20.

The ceiling 71 is a flat rectangular plate arranged to contact along the upper surface of the dielectric 40. As shown in FIG. 4, a locking portion 75 is cut and raised up at a position on the ceiling 71 slightly forward of a center in the front-rear direction. The locking portion 75 contacts the retaining edge 29 of the back wall 21 of the housing 20 to retain the shield shell 70 in the insertion portion 27. A part of the ceiling 71 in front of the rear end of the locking portion 75 projects into the receptacle 22.

The side walls 72 are rectangular flat plates that hang down from both widthwise ends of the ceiling 71 to face each other. The side walls 72 are arranged to contact the respective side surfaces of the dielectric 40. Each side wall 72 is composed of a side wall front portion 76 having a lower end edge connected to the bottom plate 73 and a side wall rear portion 77 having a free lower end edge. As shown in FIG. 4, the side wall rear portion 77 includes an additional projecting piece 78 projecting farther down than the lower end edge of the side wall front portion 76. The side wall rear portions 77 are inserted entirely into the insertion portion 27 and the additional projecting pieces 78 project into a space below the insertion portion 27.

As shown in FIGS. 6 and 7, the bottom wall 73 is composed of two closing plates 81 including divided end edges 79 projecting toward a widthwise center from the lower ends of the side wall front portions 76 of the side walls 72 and extending along the front-rear direction in a widthwise central part. Each of the closing plates 81 is a flat rectangular plate except at an opening 82 to be described later, and is arranged to contact along the lower surface of the dielectric 40. The bottom wall 73 includes the rectangular opening 82 open over the closing plates 81 by cutting the divided end edges 79. As shown in FIG. 4, a projecting portion 41 of the dielectric 40 is inserted into the opening 82 of the bottom wall 73 to be locked for retaining the dielectric 40 in the shield shell 70.

The back wall 74 is a flat rectangular plate and hangs down from the rear end edge of the ceiling 71, and both widthwise end edges thereof are arranged at a distance from the rear end edges of the side plate rear portions 77 of the side walls 72. As shown in FIG. 7, the back wall 74 and both side walls 72 are substantially perpendicular to each other.

As shown in FIG. 2, the back wall 74 includes a lower end edge 83 defining a free end arranged along the width direction. The back wall 74 has two board connecting pieces 84 projecting down from both widthwise end parts of the lower end edge 83, bent from lower end parts in a projecting direction, and extending rearward. Rear parts of the board connecting pieces 84 are held in contact along the upper surface of the board 60 and soldered to a conductor pattern for a ground circuit of the board 60. The rearward extending parts of the board connecting pieces 84 are arranged side by side with the respective lead ends 53 on both widthwise sides across the lead ends 53 of the respective terminals 50.

As shown in FIG. 4, an accommodation space 85 is present between the back wall 74 and the rear surface of the dielectric 40, and the back wall 74 faces the rear surface of the dielectric 40 across the accommodation space 85. The accommodation space 85 is defined by the back wall 74, a rear part of the ceiling 71 and the side plate rear portions 77 of the side walls 72, and the lead intermediate portions 52 (exposed surface parts) of the respective terminals 50 exposed from the rear surface of the dielectric 40 are accommodated therein.

The front surface of the back wall 74 serves as an inner surface 86 facing the lead intermediate portions 52 of the respective terminals 50 in the accommodation space 85. The rear surface of the back wall 74 is arranged on a side opposite to the inner surface 86 and serves as an outer surface 87 exposed to outside without being covered. The inner and outer surfaces 86, 87 of the back wall 74 are arranged substantially along the vertical direction, and the back wall 74 has a substantially constant plate thickness in the vertical direction. The lower end edge 83 of the back wall 74 constitutes a boundary part along a plate thickness direction from the inner surface 86 to the outer surface 87.

As shown in FIGS. 2 and 3, the back wall 74 includes bottomed recesses 88 in the outer surface 87. Each recess 88 has the same shape, extends in the vertical direction and has a closed upper end and a lower end open in the lower end edge 83 of the back wall 74. The recesses 88 are arranged between the board connecting pieces 84 in the width direction and in an area below a vertical center in the outer surface 87 of the back wall 74. Further, the respective recesses 88 are arranged to overlap facing areas between the lead intermediate portions 52 adjacent in the width direction (areas between broken lines of FIG. 2, hereinafter referred to as inter-terminal facing areas 89) in a back view with respect to the lead intermediate portions 52 of the respective terminals 50 projecting into the accommodation space 85 in the outer surface 87 of the back wall 74.

Figure 10:
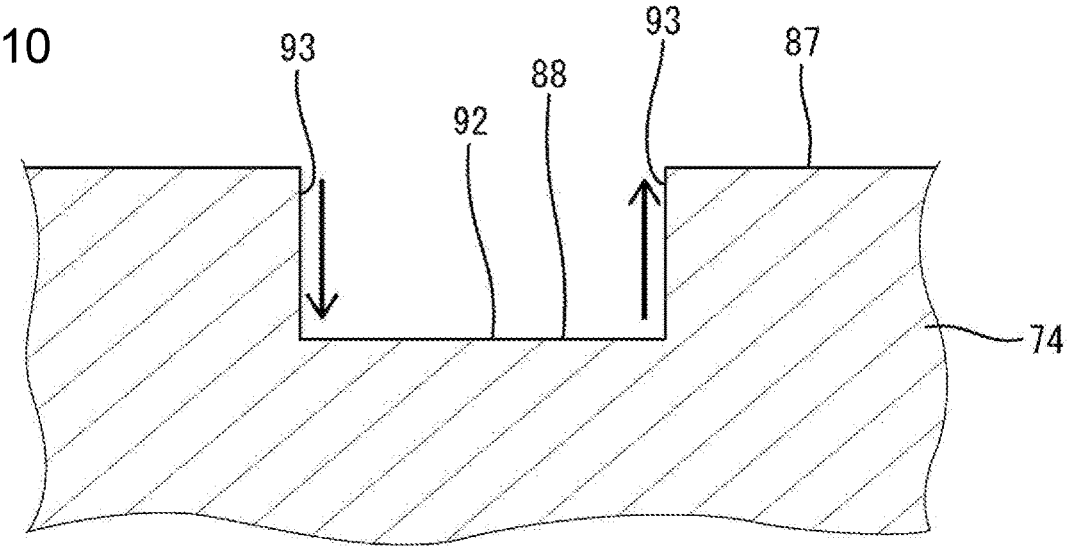
FIG. 10 is a partial enlarged view of FIG. 9(A).

The recesses 88 are formed by striking the outer surface 87 of the back wall 74 by an unillustrated press die. As shown in FIG. 10, each recess 88 has an inner back surface 92 extending along the width direction and two inner side surfaces 93 extending along the plate thickness direction to form a rectangular cross-section. A depth of the recess 88 is about half the plate thickness of the back wall 74. Further, as the back wall 74 is struck by the press die to form the recesses 88, forward bulges 91 corresponding to the recesses 88 bulge forward on the inner surface 86, as shown in FIG. 7.

In assembling the shield connector 10, the dielectric 40 is held in the shield shell 70 and the shield shell 70 is inserted into the insertion portion 27 of the back wall 21 to be held.

As shown in FIG. 4, a flat surface part (part except the respective recesses 88) of the outer surface 87 of the back wall 74 is substantially continuous and flush with the rear surface of the back wall 21 of the housing 20. Front parts of the mating terminal connecting portions 51 of the respective terminals 50 project from the front surface of the dielectric 40 and are arranged in the receptacle 22 together with a front part of the shield shell 70.

Rear parts of the mating terminal connecting portions 51 and the lead intermediate portions 52 of the respective terminals 50 are arranged to project into the accommodation space 85 from the rear surface of the dielectric 40. As shown in FIG. 2, the lead end portions 53 of the respective terminals 50 are arranged to be exposed on an outer rear side through windows 94 in the form of rectangular recesses in a back view defined between the board connecting pieces 84 and the lower end edge 83 in the back wall 74. Lower parts of the lead intermediate portions 52 of the terminals 50 are exposed to the windows 94 from the lower end edge 83 of the back plate 74 and are arranged side by side in the width direction. The lead ends 53 of the terminals 50 and the rearward extending parts of the board connecting pieces 84 are arranged between the protection walls 31 in the width direction and are protected by the protection walls 31.

When the shield connector 10 is mounted on and fixed to the board 60, the lead ends 53 of the terminals 50 and the rearward extending parts of the board connecting pieces 84 are soldered to the conductor patterns for the signal circuit and the ground circuit of the board 60. When signal currents flow in the respective terminals 50, currents (return currents) paired with the signal currents flow on the inner surface 86 of the back wall 74 facing the lead intermediate portions 52 of the respective terminals 50.

Figure 8:
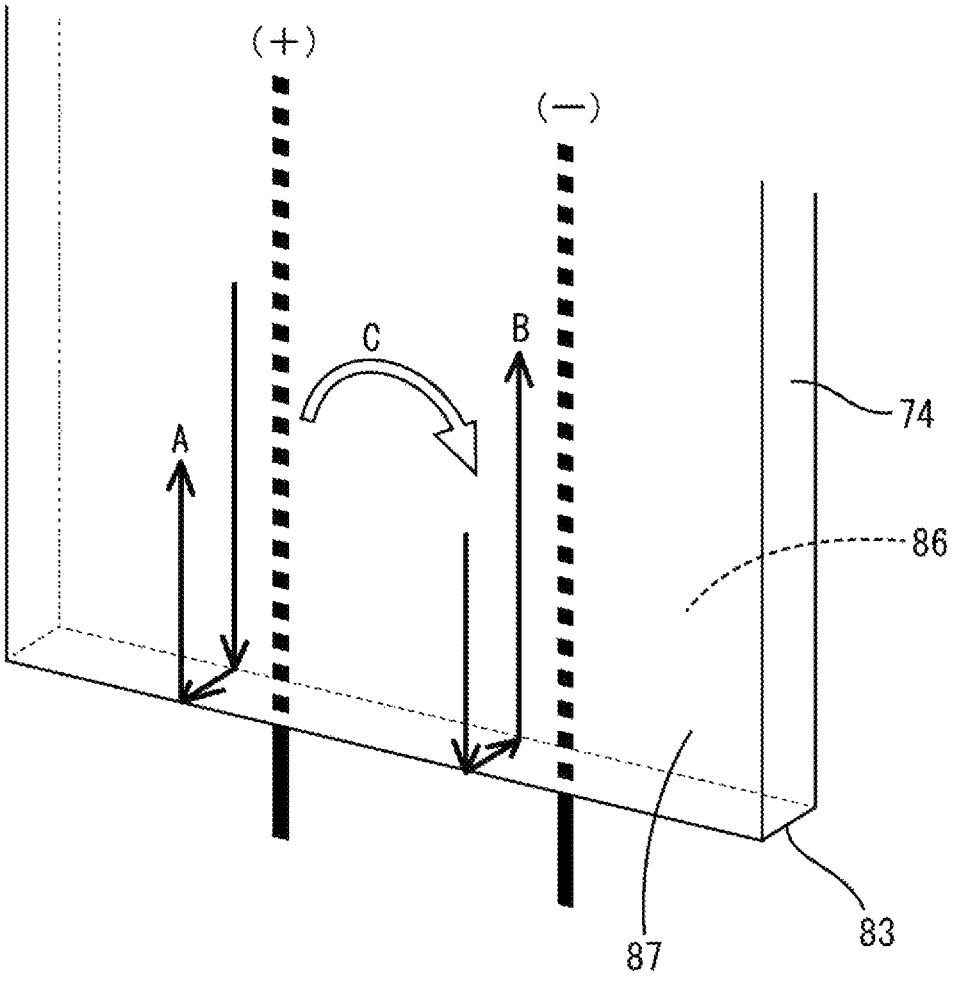
FIG. 8 is a conceptual diagram showing current flows.

The shield shell 70 is grounded to the conductor pattern for the ground circuit via the both board connecting pieces 84, and includes the lower end edge 83 of the back wall 74 between the board connecting pieces 84. Thus, some currents flow around to the outer surface 87 via the lower end edge 83 from the inner surface 86 of the back wall 74 and flow on the outer surface 87 of the back wall 74, as shown in FIG. 8. Particularly, currents tend to be concentrated on the outer surface 87 of the back wall 74 due to a skin effect. Thus, a current vector indicated by an arrow A and serving as a current supply source is generated on the outer surface 87 of the back wall 74 and, further, a current vector indicated by an arrow B and serving as a current consumption source (offset source) and a current vector indicated by an arrow C and flowing between currents are generated. Such currents flowing on the outer surface 87 of the back wall 74 become a neighborhood noise source and may adversely affect outside.

However, in the case of this embodiment, the recesses 88 are provided side by side in a direction of the current vector indicated by the arrow C in the inter-terminal facing areas 89 of the back wall 74, whereby an increase in current density on the outer surface 87 of the back wall 74 is suppressed and neighborhood noise is reduced.

Figure 9A:
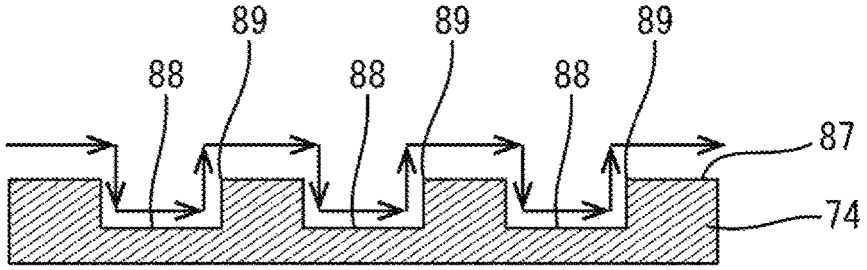
FIG. 9(A) is a section schematically showing a current flow of the embodiment.
Figure 9B:
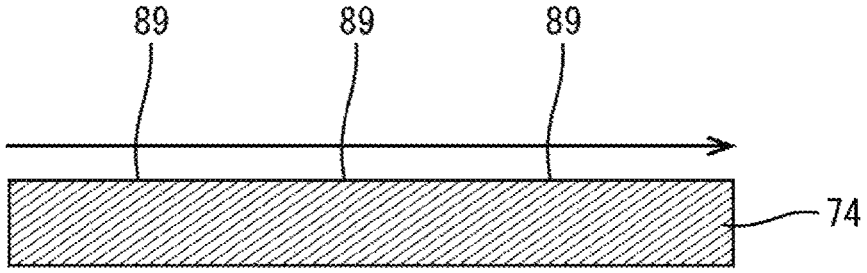
FIG. 9(B) is a section schematically showing a current flow of a comparative example.

Specifically, since the inter-terminal facing areas 89 of the back wall 74 include the respective recesses 88, a surface area is larger as compared to the case where no recess 88 is provided. Thus, if the same amount of current is supplied indirectly from signal currents flowing in the respective terminals 50 to a mode of the first embodiment in which the inter-terminal facing areas 89 of the back wall 74 include the respective recesses 88 (FIG. 9(A) and a mode of a comparative example in which the inter-terminal facing areas 89 of the back wall 74 include no recess 88 (FIG. 9B), a current amount per unit area (current density) is smaller in the mode of this embodiment than in the mode of the comparative example since the currents detour as indicated by arrows of FIG. 9A. Further, since the inner side surfaces 93 of each recess 88 are arranged parallel to each other along the plate thickness direction as shown in FIG. 10 in the mode of this embodiment, the currents are canceled out by current vectors opposite to each other on the both inner side surfaces 93 of the recess 88.

Thus, in the mode of this embodiment, the radiation of electromagnetic waves from the shield shell 70 is suppressed and neighborhood noise can be reduced as compared to the mode of the comparative example. Actually, it was confirmed that neighborhood noise could be reduced by 2 to 15% in the mode of this embodiment as compared to the mode of the comparative example.

As described above, since the inter-terminal facing areas 89 on the outer surface 87 of the back wall 74 include the recesses 88 according to this embodiment, the current density of the currents flowing in the inter-terminal facing areas 89 can be reduced and neighborhood noise can be reduced. As a result, an original shielding mechanism of the shield connector 10 can be demonstrated without any problem.

Further, since the lower ends of the recesses 88 reach the lower end edge 83 of the back wall 74 and are open, these lower ends serve as starting points of the currents flowing around to the outer surface 87 of the back wall 74 and neighborhood noise can be reduced on the side of the lower end edge 83 (lower side of the back wall 74) where the current density tends to be high. In addition, since the respective recesses 88 are provided individually to correspond to intervals between the lead intermediate portions 52 of the terminals 50 and the recesses 88 are provided on the outer surface 87 of the back plate wall 74, the current density can be reduced and an effect of reducing neighborhood noise can be enhanced. Furthermore, the bottomed recesses 88 can be easily formed by striking the outer surface 87 of the back wall 74 by the press die and the formation of the recesses 88 is not accompanied by manufacturing difficulty.

Other embodiments are briefly described below.

The bottomed recesses may have a U-shaped or V-shaped cross-section.

The back wall may include projections at positions facing areas, across which the respective terminals are adjacent in the width direction, on the outer surface on the side opposite to the side facing the respective terminals. In this case, the lower ends of the projections preferably reach the lower end edge of the back wall and the projections are preferably arranged side by side in the width direction. The projections may be formed by striking the inner surface of the back wall by a die. Further, the projections may have any one of rectangular, triangular and semicircular cross-sections.

A plurality of the bottomed recesses or projections may be provided at positions facing the areas, across which the respective terminals are adjacent in the width direction (inter-terminal facing areas), on the outer surface of the back wall.

The lead end of the terminal may not be bent from the lead intermediate portion and may be inserted and connected to a through hole of the board.

The invention is also applicable to a board shield connector of a vertical type in which an opening surface of a receptacle is facing up with respect to the upper surface of the board. In this case, each terminal may have the exposed surface of the invention in a lower end part exposed from a dielectric, and a housing may include the cover of the invention on a lower peripheral wall covering a lower end part of each terminal.

The invention is applicable also to connectors that are not board connectors. In this case, a terminal may be connected to an end part of a shielded cable.

LIST OF REFERENCE SIGNS

10 . . . shield connector
20 . . . housing
40 . . . dielectric
50 . . . terminal
70 . . . shield shell
74 . . . back plate portion (cover)
86 . . . inner surface
87 . . . outer surface
88 . . . recess
89 . . . inter-terminal facing area

What is claimed is:

1. A shield connector, comprising:

a dielectric having opposite front and rear end surfaces;

terminals arranged side by side in a width direction, each of the terminals having a connecting portion projecting through the dielectric in a front-rear direction, a lead intermediate portion extending angularly from a rear end of the connecting portion and being opposed to the rear end surface of the dielectric; and a shield shell for collectively surrounding the dielectric and the terminals on an outer peripheral side, the shield shell including a cover for opposed to and spaced rearward from the rear surface of the dielectric and covering an exposed surface of the connecting portion of each terminal that is exposed from the dielectric, the cover of the shield shell including bottomed recesses or projections at positions facing an area, across which the lead intermediate portions of the respective terminals are adjacent in the width direction, the bottomed recesses or projections having surfaces extending substantially parallel to the rear end surface of the dielectric.

2. The shield connector of claim 1, wherein end parts of the respective terminals are exposed side by side in the width direction from an end edge of the cover, and one end of the bottomed recess or projection reaches the end edge of the cover.

3. The shield connector of claim 1, wherein a plurality of the bottomed recesses or projections are arranged side by side in the width direction.

4. The shield connector of claim 1, wherein the cover includes the bottomed recess at the position facing the area, across which the respective terminals are adjacent in the width direction, on the outer surface on the side opposite to the inner surface facing the respective terminals.

5. The shield connector of claim 1, wherein the cover of the shield shell includes a lower edge, the bottomed recesses or projections extending from the lower edge of the cover to positions spaced from the lower edge of the cover.

6. The shield connector of claim 1, wherein the bottomed recesses or projections at least partly align with spaces between the lead intermediate portions of the respective terminals.

7. The shield connector of claim 1, wherein the bottomed recesses or projections comprise bottomed recesses on surfaces of the cover facing away from the rear end surface of the dielectric and projections on surfaces of the cover facing toward the rear end surface of the dielectric at positions opposite the respective bottomed recesses.

8. The shield connector of claim 1 further comprising a housing configured for mounting on a circuit board, the dielectric, the terminals and the shield shell being mounted in the housing, the cover of the shield shell including a lower end edge facing toward the circuit board, the bottomed recesses or projections extending from the lower end edge of the cover and in a direction away from the circuit board.

9. A shield connector, comprising:

a dielectric having opposite front and rear end surfaces;

terminals arranged side by side in a width direction, each of the terminals having a connecting portion projecting through the dielectric in a front-rear direction, a lead intermediate portion extending angularly from a rear end of the connecting portion and being opposed to the rear end surface of the dielectric; and a shield shell collectively surrounding the dielectric and the terminals on an outer peripheral side, the shield shell including a cover opposed to and spaced rearward from the rear surface of the dielectric and covering an exposed surface of the connecting portion of each terminal that is exposed from the dielectric, the cover of the shield shell including a lower edge extending in the width direction, the cover of the shield shell further being deformed to define an array of substantially parallel bottomed recesses extending away from the lower edge, each of the bottomed recesses having an inner back surface aligned substantially parallel to the width direction and transverse to the front rear direction.

10. The shield connector of claim 9, wherein the bottomed recesses at least partly align with spaces between the lead intermediate portions of the respective terminals.

11. The shield connector of claim 9, wherein the bottomed recesses comprise bottomed recesses on surfaces of the cover facing away from the rear end surface of the dielectric, and the cover of the shield shell further comprises projections on surfaces of the cover facing toward the rear end surface of the dielectric at positions opposite the respective bottomed recesses.

12. The shield connector of claim 9, further comprising a housing configured for mounting on a circuit board, the dielectric, the terminals and the shield shell being mounted in the housing, the cover of the shield shell including a lower end edge facing toward the circuit board, the bottomed recesses or projections extending from the lower end edge of the cover and in a direction away from the circuit board.

* * * * *